US007483648B2

(12) United States Patent
Hosokawa et al.

(10) Patent No.: US 7,483,648 B2
(45) Date of Patent: Jan. 27, 2009

(54) PROCESS CARTRIDGE AND IMAGE FORMING APPARATUS USING THE SAME

(75) Inventors: Hiroshi Hosokawa, Kanagawa (JP); Atushi Sampe, Kanagawa (JP); Hiroyuki Nagashima, Kanagawa (JP); Nobuo Kuwabara, Kanagawa (JP); Yoshiyuki Kimura, Tokyo (JP); Wakako Murakami, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 220 days.

(21) Appl. No.: 11/182,863

(22) Filed: Jul. 18, 2005

(65) Prior Publication Data

US 2006/0018680 A1 Jan. 26, 2006

(30) Foreign Application Priority Data

Jul. 20, 2004 (JP) ..... 2004-211347

(51) Int. Cl.
*G03G 15/00* (2006.01)

(52) U.S. Cl. ..... 399/107; 399/111; 399/112

(58) Field of Classification Search ..... 399/111, 399/112, 107

See application file for complete search history.

(56) References Cited

U.S. PATENT DOCUMENTS

2004/0096239 A1* 5/2004 Hosokawa et al. ..... 399/111
2004/0101328 A1 5/2004 Kimura et al.
2004/0131381 A1 7/2004 Kawasumi et al.
2004/0136763 A1 7/2004 Murakami et al.
2004/0141779 A1 7/2004 Yanagida et al.
2004/0170446 A1 9/2004 Nagashima et al.
2004/0170447 A1 9/2004 Arai et al.
2004/0170455 A1 9/2004 Shintani et al.
2004/0184841 A1 9/2004 Tsuda et al.
2004/0190936 A1 9/2004 Yoshiyuki et al.
2004/0202495 A1 10/2004 Koike et al.
2004/0213597 A1 10/2004 Yanagida et al.
2004/0223782 A1 11/2004 Hosokawa et al.
2004/0228648 A1 11/2004 Yanagida et al.
2004/0265011 A1 12/2004 Tsuda et al.

(Continued)

FOREIGN PATENT DOCUMENTS

JP 2002-6679 1/2002

(Continued)

OTHER PUBLICATIONS

U.S. Appl. No. 11/287,305, filed Nov. 28, 2005, Hosokawa et al.

(Continued)

*Primary Examiner*—David M Gray
*Assistant Examiner*—Ryan D Walsh
(74) *Attorney, Agent, or Firm*—Oblon, Spivak, McClelland, Maier & Neustadt, P.C.

(57) ABSTRACT

A process cartridge of the present invention includes a casing capable of accommodating a plurality of units positioned one above the other in a space such that one unit is spaced, in the horizontal direction, from a vertical line extending through the other unit positioned below the one unit. The casing has a bottom wall inclined relative to a horizontal plane and oriented such that when the bottom wall is placed on a horizontal surface, the one unit is shifted toward the vertical line.

20 Claims, 12 Drawing Sheets

U.S. PATENT DOCUMENTS

| | | | | |
|---|---|---|---|---|
| 2005/0002705 | A1 | 1/2005 | Shintani et al. | |
| 2005/0025520 | A1 | 2/2005 | Murakami et al. | |
| 2005/0036805 | A1 | 2/2005 | Murakami et al. | |
| 2006/0008296 | A1 * | 1/2006 | Sampe et al. | 399/167 |

FOREIGN PATENT DOCUMENTS

| | | |
|---|---|---|
| JP | 2003-202728 | 7/2003 |
| JP | 2003-316107 | 11/2003 |

OTHER PUBLICATIONS

U.S. Appl. No. 11/736,881, filed Apr. 18, 2007, Hosokawa et al.
U.S. Appl. No. 11/679,010, filed Feb. 26, 2007, Arai et al.
U.S. Appl. No. 11/856,304, filed Sep. 17, 2007, Oshige et al.
U.S. Appl. No. 11/935,106, filed Nov. 5, 2007, Muraishi et al.
U.S. Appl. No. 12/093,753, filed May, 15, 2008, Oshige et al.
U.S. Appl. No. 12/094,198, filed May 19, 2008, Kato et al.

* cited by examiner

PROCESS CARTRIDGE AND IMAGE FORMING APPARATUS USING THE SAME

BACKGROUND OF THE INVENTION

1. Field of the Invention

The present invention relates to a process cartridge accommodating a plurality of process units for image formation therein and an image forming apparatus using the same.

2. Description of the Background Art

It is a common practice with an electro photographic image forming apparatus to form a latent image on a photoconductive element or image carrier, develop the latent image to thereby produce a corresponding toner image, and transfer the toner image to a paper sheet or similar recording medium. Such an image forming apparatus is implemented as a copier, a printer, a facsimile apparatus or a multifunction machine having at least two of the functions available therewith by way of example, as taught in, e.g., Japanese Patent Laid-Open Publication No. 2002-6679 (page 3 and FIG. 1).

The image forming apparatus of the type described is provided with a single photoconductive element assigned to a single color or a plurality of photoconductive elements each being assigned to one of a plurality of different colors. The image forming apparatus with a single photoconductive element may be implemented as, e.g., a monochromatic copier while the image forming apparatus with a plurality of photoconductive elements may be implemented as, e.g., a color copier.

One of conventional methods available for forming a full-color image forms toner images of different colors on respective photoconductive elements with developers complementary to separated colors, and sequentially transfers the toner images to a paper sheet or similar recording medium one above the other. Another conventional method sequentially transfers the toner images from the photoconductive elements to an intermediate image transfer body one above the other and then transfers the resulting full-color image from the intermediate image transfer body to a paper sheet.

A tandem image forming apparatus taught in, e.g., Japanese Patent Laid-Open Publication No. 2003-316107 (column [0010]) is another full-color image forming apparatus and has a plurality of photoconductive elements arranged side by side along an intermediate image transfer belt. To reduce the overall size of the tandem image forming apparatus, Japanese Patent Laid-Open Publication No. 2003-202728, for example, proposes to arrange image forming stations each being assigned to a particular color and image transferring devices facing them in an inclined position.

As for a tandem image forming apparatus, Laid-Open Publication No. 2003-216107 mentioned above further discloses process cartridges mounted on the apparatus each accommodating a photoconductive element assigned to a particular color and various process units for image formation.

Generally, when a process cartridge includes a photoconductive element and a developing device for developing a latent image formed on the photoconductive element, it is likely that a developer stored in the developing device accidentally leaks to the outside due to vibration during transport or installation. In light of this, the process cartridge is sometimes dealt with as unit packed independently of an image forming apparatus.

When the process cartridge in use on the image forming apparatus must be replace because of the limited life of any part thereof or when a space must be temporarily provided within the image forming apparatus for maintenance or inspection, the process cartridge is sometimes dismounted from the apparatus and then placed on a desk or similar horizontal surface.

On the other hand, some developer is stored in the developing device included in the process cartridge at the beginning, so that the developer can be rapidly fed as soon as the process unit is mounted to the image forming apparatus. In this case, the developer is often implemented as a two-ingredient type developer, i.e., a toner and carrier mixture.

A prerequisite with a toner and carrier mixture is to deposit a preselected amount of charge on toner grains by mixing and agitating toner grains and carrier grains together. To meet this prerequisite, Laid-Open Publication Nos. 2002-6679 and 2003-202728 mentioned earlier each propose a particular configuration wherein a pair of screws for conveyance and a sleeve for development are accommodated in respective spaces. The toner and carrier grains are electrified by agitation in the space accommodating the screws. On the other hand, when the process cartridge is new, some amount of developer charged beforehand is stored.

In any case, in a new process cartridge, a seal member separates the above two spaces assigned to the screws and sleeve, respectively, in order to prevent the developer in the former from accidentally entering the latter and then leaking to the outside via gaps between exposed part of the sleeve, which faces a photoconductive element, and the inner periphery of the space accommodating it. After the new process cartridge has been mounted to an image forming apparatus, the seal member is pulled out to provide communication between the two spaces for thereby allowing the developer to be fed to the sleeve by the screws.

A process cartridge wherein a developing sleeve is positioned above a pair of screws may be arranged in matching relation to the inclination of an image transferring device, as taught in, e.g., Laid-Open Publication Nos. 2002-2279 and 2003-202728. More specifically, when a new process cartridge or a process cartridge dismounted from an image forming apparatus is placed on a desk or similar flat surface, it is put in the same position as when mounted on the apparatus, i.e., the sleeve is so positioned as to feed the developer to a photoconductive element while facing it. It is therefore likely that the developer deposited on the sleeve accidentally leaks to the outside of the process cartridge or that, when the space accommodating the sleeve is not sealed, the developer enters the space adjoining the sleeve and also leak to the outside at the position where sleeve is exposed.

In light of the above, it is necessary to prepare a special base or similar structural part configured to support the process cartridge such that the exposed portion of the sleeve is not positioned in the same orientation as when mounted on the apparatus. However, it is difficult for the user of the apparatus to prepare such a special base, forcing the user to rely on a serviceman call.

SUMMARY OF THE INVENTION

It is an object of the present invention to provide a process cartridge configured to prevent, when dismounted or held in a packed condition, a developer stored therein from leaking without resorting to any special structural part, and an image forming apparatus using the same.

A process cartridge of the present invention includes a casing capable of accommodating a plurality of units positioned one above the other in a space such that one unit is spaced, in the horizontal direction, from a vertical line extending through the other unit positioned below the one unit. The casing has a bottom wall inclined relative to a horizontal plane and oriented such that when the bottom wall is placed on a horizontal surface, the one unit is shifted toward the vertical line.

An image forming apparatus using the process cartridge stated above is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
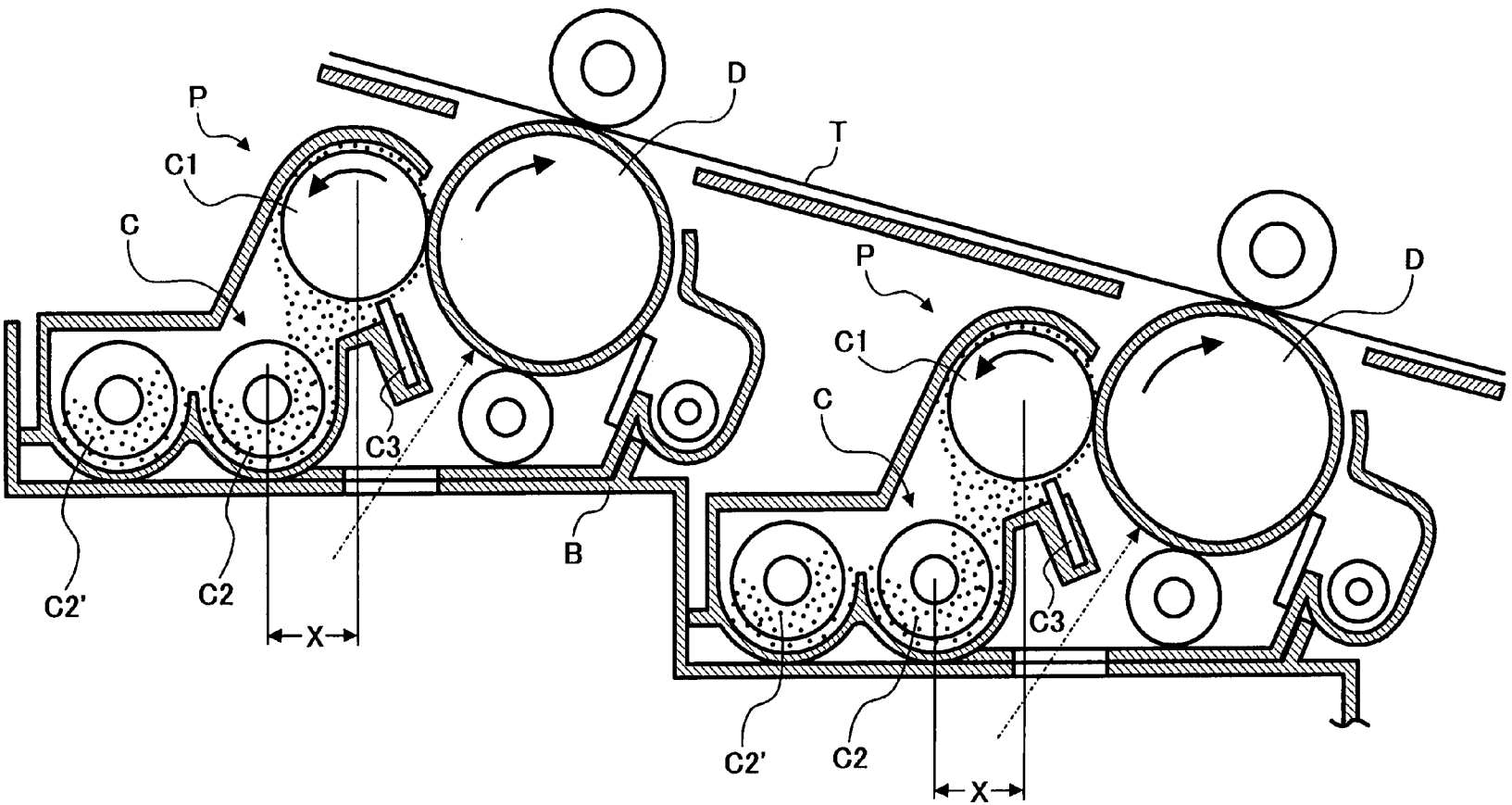
FIG. 1 PRIOR ART
FIG. 1 is a view showing a specific configuration of a conventional image forming apparatus including an image transfer belt held in an inclined position.

To better understand the present invention, brief reference will be made to a conventional image forming apparatus shown in FIG. 1. As shown, the image forming apparatus includes a partly inclined image transfer belt T and process cartridges P arranged side by side along the image transfer belt T. The process cartridges P each are supported by a guide B at its bottom and slidable in a direction perpendicular to the sheet surface of FIG. 1. The guide B forms part of a support structure included in the apparatus.

More specifically, a developing unit or device C is included in each process cartridge and slidably positioned on the upper surface of the guide B. The developing unit C includes a developing sleeve C1 facing a photoconductive drum D, agitators or conveying members C2 and C2' implemented by augers and a doctor blade C3. The photoconductive drum (simply drum hereinafter) D is a specific form of an image carrier on which a toner image is to be formed. The doctor blade C3 regulates, or meters, the height of a developer deposited on the circumfential surface of the drum C1.

In each developing unit P, the developing sleeve (simply sleeve hereinafter) C1 is spaced from a vertical line extending from the agitator C2, which is positioned below the sleeve C1, in the horizontal direction. More specifically, the sleeve C1 needs, as to its rotation phase, a developer portion and a developer metering portion at positions short of a position where the sleeve C1 faces the drum D. Therefore, to provide the sleeve C1 with a circumferential length corresponding to the above two portions, the axis of the sleeve C1 is not positioned right above the axis of the agitator or conveyor C2, but is shifted from the same by a distance X in the horizontal direction.

In the above configuration, when a new process cartridge or the process cartridge P dismounted from the apparatus is placed on a desk or similar flat surface, it is put in the same position as when mounted on the apparatus, i.e., the sleeve C1 is put in a position ready to feed the developer to the drum D while facing it. It is therefore likely that the developer deposited on the sleeve C1 accidentally leaks to the outside of the process cartridge P or that, when the spaces accommodating the sleeve C1 and agitator C2 are not sealed, the developer enters the space assigned to the sleeve C1 and also leak at the position where the sleeve C1 is exposed to the outside.

In light of the above, it is necessary to prepare a special base or similar structural part configured to support the process cartridge P such that the exposed portion of the sleeve C1 is not positioned in the same orientation as when mounted on the apparatus. However, it is difficult for the user of the apparatus to prepare such a special base, forcing the user to rely on a serviceman call, as stated earlier.

Figure 2:
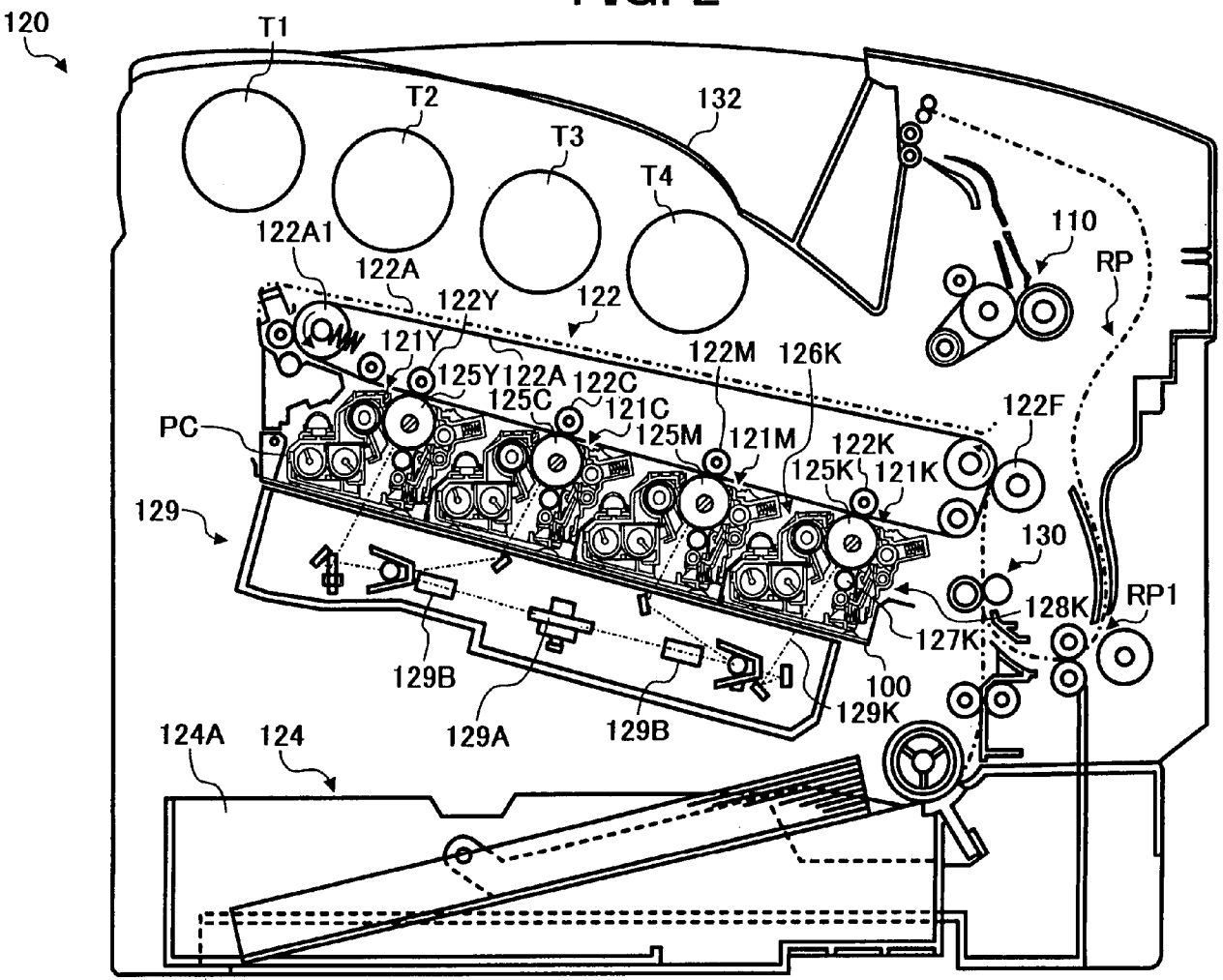
FIG. 2 is a view showing an image forming apparatus embodying the present invention.

Referring to FIG. 2, an image forming apparatus embodying the present invention is shown and implemented as a tandem color printer capable of forming a full-color image by way of example. It should be noted that the present invention is, of course, similarly applicable to any other image forming apparatus, e.g., a copier, a facsimile apparatus or a printer.

As shown in FIG. 2, the color printer, generally 120, includes image forming devices or units 121Y (yellow), 121C (cyan), 121M (magenta) and 121K (black) each for forming an image of a particular color. An image transferring devices 122 is positioned to face the image forming devices 121Y through 121K. A manual sheet feed tray, not shown, and a sheet feeding device 124 including a sheet cassette 124A each constitute sheet feeding means for feeding a paper sheet or similar recording medium to consecutive image transfer positions between the image forming device 121 and the image transferring devices 122Y through 122K. A registration roller pair 130 once stops the paper sheet fed from the manual sheet feed tray or the sheet cassette 124 and then conveys it in synchronism with the operation of the image forming devices 121Y through 121K. A fixing unit 110 fixes a toner image transferred to the paper sheet.

The fixing unit 110 uses a conventional belt fixing system including a fixing roller and a press roller facing each other and a fixing belt passed over the fixing roller and a heat roller. The fixing belt, heated by the heat roller, contacts the paper sheet being conveyed via a nip between the fixing roller and the press roller, so that the toner image is fixed on the paper sheet by heat and pressure.

The image transferring device 122 is implemented as an endless, image transfer belt or image transfer body 122A passed over a plurality of rollers. Bias applying means 122Y, 122C, 122M and 122K respectively face photo conductive drums 125Y, 125C, 125M and 125K respectively included in the image forming devices 121Y, 121C, 121M and 121K. The bias applying means 122Y through 122K apply biases of opposite polarity to toner in order to sequentially transfer toner images formed by the image forming devices 121Y through 121K to the image transfer belt 122A one above the other for thereby forming a full-color image. The image transferring device 122 further includes secondary image transferring means 122F positioned on a sheet conveyance path for transferring the above full-color image from the image transfer belt (simply belt hereinafter) 122A to the paper sheet.

The color printer 120 is operable with various kinds of sheets including plain sheets customary with, e.g., a copier, OHP (OverHead Projector) films, cards, postcards and other relatively thick sheets corresponding to weight of 100 g/m$^2$, and envelopes and other special sheets greater in thermal capacity than sheets.

Because the image forming devices 121Y through 121K are substantially identical in configuration with each other except for the color of toner to use, let the following description concentrate on the image forming device 121K by way of example.

Figure 3:
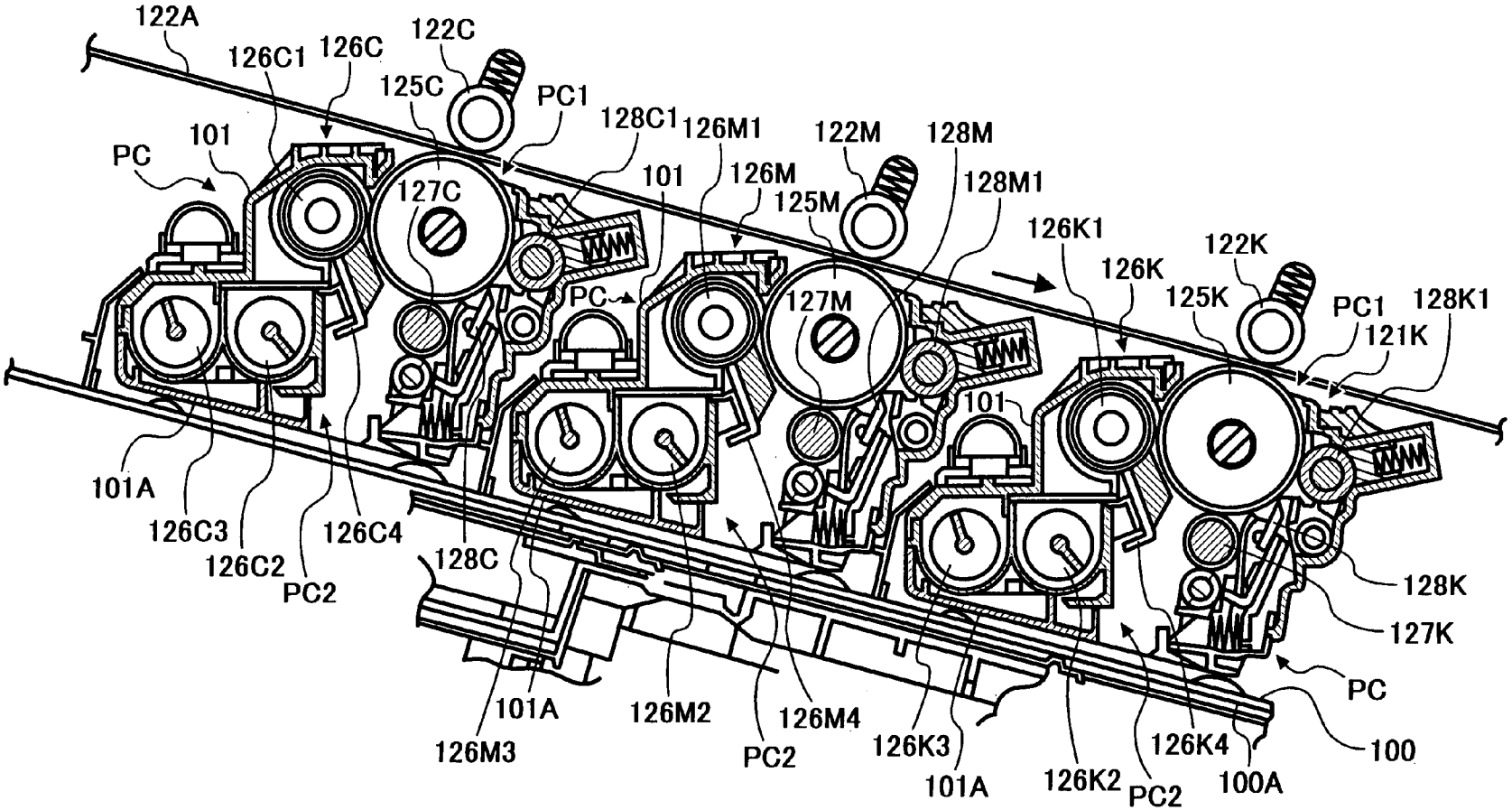
FIG. 3 shows arrangements inside a process cartridge included in the illustrative embodiment.

As shown in FIGS. 2 and 3, the image forming apparatus 121K includes the photo conductive drum (simply drum here in after) 125K mentioned earlier. The drum 125 is a specific form of an image carrier on which a toner image is to be formed. A charger 127K, a developing device 126K and a cleaning device 128K are sequentially arranged in this order around the drum 125K in the direction of rotation of the drum 125K. A light beam 129K, modulated in accordance with image data of a particular color and emitted from an optical writing unit 129, scans the drum 125K at a position between the charger 127K and the developing device 126K, forming an electrostatic latent image on the drum 125K. In the illustrative embodiment, the cleaning device 128K includes, in addition to a conventional cleaning blade, a mechanism 128K1 for coating a lubricant on the drum 125K in order to promote efficient removal of impurities.

The drum 125K may, of course, be replaced with a photoconductive belt, if desired. As shown in FIG. 3, the process units arranged around the drum 125K for forming an image, as stated above, all are accommodated in a casing included in a process cartridge or unit PC.

As shown in FIG. 2, the image transferring device 122 is inclined such that the downstream side of the belt 122A, as seen in a direction in which the lower run of the belt 122A facing the image forming devices 121Y through 121K moves, is lower in level or height than the upstream side of the belt 122A passed over a roller 122A1. This configuration is successful to reduce a space to be occupied by the image transferring device 122 and therefore the overall size of the image color printer or image forming apparatus 120.

The operation of the color printer 120 will be described hereinafter. While the following description concentrates on the operation of the image forming apparatus 121K, the other image forming devices 121Y, 121C and 121M operate in the same manner as the image forming apparatus 121K.

In operation, the drum 125K is rotated by a main motor, not shown, while an AC bias, not containing a DC component, is applied to the charger 127K for discharging the surface of the drum 125K to a reference voltage of −50 V. Subsequently, an AC-biased DC bias is applied to the charger 127K to uniformly charge the surface of the drum 125K to a target voltage of substantially −500 V to −700 V, which is substantially the same as the DC component. Such a target voltage or charge potential is determined by a process controller not shown.

After the drum 125K has been uniformly charged, as stated above, the optical writing unit 129 forms a latent image on the drum 125K in accordance with digital image data output from a controller not shown. More specifically, in the optical writing unit 129, a laser diode emits a laser beam based on an emission signal digitized color by color in accordance with the digital image data. The laser beam scans the surface of the drum, drum 125K in this case, via a cylindrical lens, not shown, a polygonal mirror 129A, an fθ lens 129B, a first to a third mirror and a WTL lens. The surface potential of part of the drum 125K thus scanned by the laserbeam is varied to substantially −50 V, forming a latent image corresponding to the image data.

The developing device 126K develops the latent image formed on the drum 12SK with toner complementary to the separated color. More specifically, an AC-biased DC voltage of −300 V to −500 V is applied to a sleeve 126K1 with the result that the toner deposits only on the latent image where the potential is lowered for thereby developing it. In the illustrative embodiment, the charge-to-mass ratio Q/M is between −20 C/g to −30 C/g.

A toner image formed on the drum 125K is transferred to a paper sheet or similar recording medium conveyed by the registration roller pair 130 at preselected registration timing. More specifically, adhesion bias applying means, implemented as a roller, applies a bias to the sheet before the sheet reaches the belt 122A to thereby cause the sheet to electrostatically adhere to the belt 122A.

Transfer bias applying means 122Y, 122C, 122M and 122K are included in the image transferring device 122 and respectively face the drums 125Y, 125C, 125M and 125K. Toner images of different colors, formed on the drums 125Y through 125K by the procedure described above, are sequentially transferred to the belt 122A one above the other by biases of opposite polarity to toner applied by the transfer bias applying means 122Y through 122K, completing a full-color toner image on the belt 122A. The full-color toner image is then transferred from the belt 122A to the paper sheet by secondary image transfer bias applying means 122F.

The paper sheet, carrying the full-color toner image thereon, is peeled off from the belt 122A by a roller included in an image transfer belt unit, e.g., a roller opposite in position to the roller 122A1, FIG. 2, on the basis of curvature. The paper sheet is then conveyed to the fixing unit 110. The fixing unit 110 fixes the toner image on the paper sheet with heat and pressure at the nip between the fixing belt and the press roller. Finally, the paper sheet or print is driven out of the color printer to a print tray 132.

The colorprinter shown in FIG. 2 is selectively operable in a simplex print mode for forming an image on one side of a paper sheet, as stated above, or a duplex print mode for forming images on both sides of a paper sheet. When the duplex print mode is selected, the paper sheet, carrying the toner image on one side thereof and come out of the fixing unit 110, is steered into a sheet turn path RP and again conveyed toward the registration roller pair 130 by a roller PR1, which is positioned at the end of the sheet turn path RP and bifunctions as a pickup roller for the manual sheet feed tray not shown. A path selector, not shown, is positioned downstream of the fixing unit 110 to selectively steer the paper sheet in the simplex and duplex copy modes.

It should be noted that the charge potentials and other various properties stated above are, of course, only illustrative and may be varied in matching relation to, e.g., color or density. Labeled T1 through T4 in FIG. 2 are toner cartridges removably mounted to the color printer 120 for replenishing fresh toner to the developing devices as conventional.

As shown in FIG. 3 specifically, the process cartridges PC, constituting the consecutive image forming sections, each include a casing 101 having a bottom wall 101A inclined relative to a horizontal plane. The angle of inclination is selected such that the bottom wall 101A is parallel to the inclined surface of a guide member 100, which is disposed in the printer body for slidably supporting the process cartridges PC.

More specifically, because the image transferring device 122 is bodily inclined in the position stated previously, the lower run of the belt 122A is also inclined relative to a horizontal plane in accordance with the inclination of the device 122. Therefore, the guide member 100 is inclined parallel to the lower run of the belt 122A in order to cause the drums 125 of the process cartridges PC to face the belt 122A. For this reason, the bottom wall 101A of each casing 101, slidably supported by the guide member 100, is inclined parallel to a mount surface 100A on which the guide member 100 is mounted. In the illustrative embodiment, the bottom wall 101A is inclined by 15° in matching relation to the inclination of the image transferring device 122.

On the other hand, the developing device or unit 125K of the process cartridge includes a sleeve 126K1 facing the drum 125K. A first and a second screw 125K2 and 126K3, serving as conveying members, are positioned below the sleeve 126K1 and disposed in a space different from a space accommodating the sleeve 126K1 for conveying a developer toward the sleeve 126K1. A doctor blade 126K4 regulates the thickness of the developer deposited on the sleeve 126K1 in the form of a layer.

The first and second screws 126K2 and 126K3 are positioned side by side in the horizontal direction relative to the inclined bottom wall 101A. The sleeve 126K1 is spaced, in the horizontal direction, from a vertical line L2 shown in FIGS. 4A and 4B that passes through the axis of the first screw 126K2.

Figure 4A:
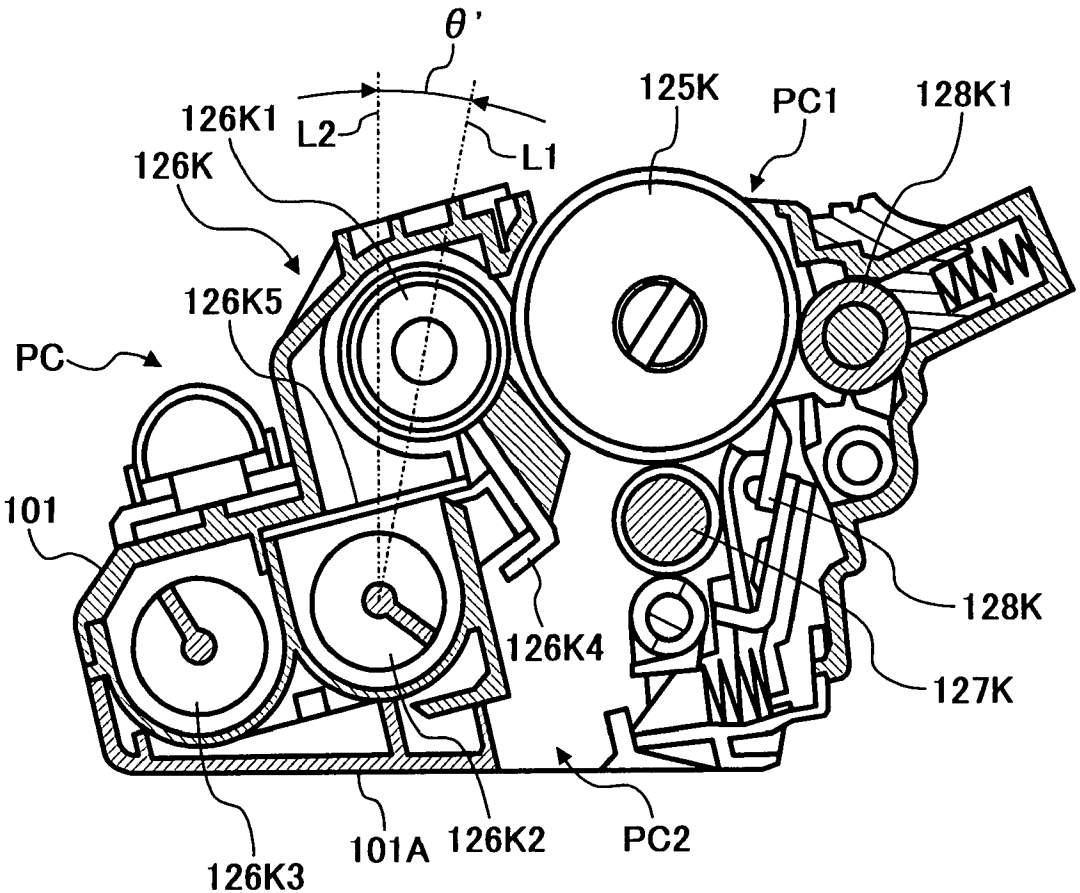
FIG. 4A shows the process cartridge in a condition wherein its bottom is placed on a flat surface.
Figure 4B:
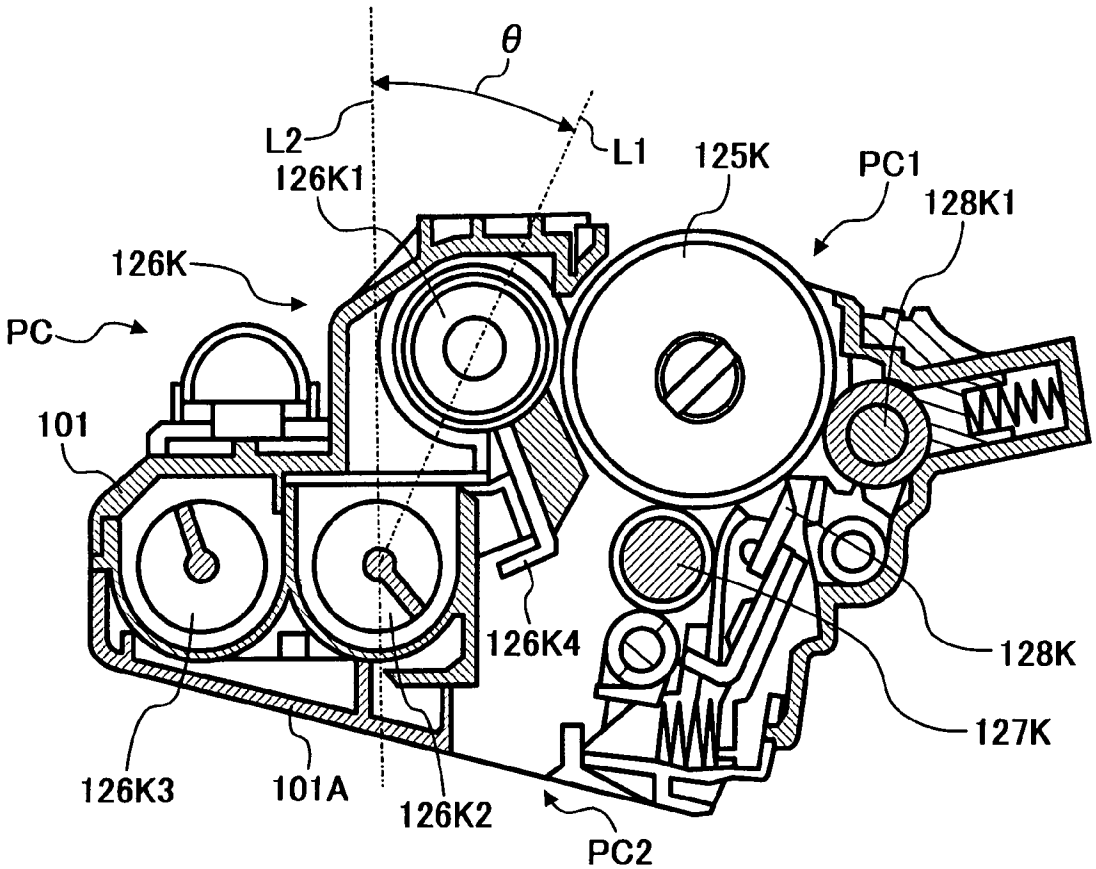
FIG. 4B shows the bottom of the process cartridge held in an operative position on the apparatus.

The configuration of the bottom wall 101A of the casing 101 will be described more specifically. FIG. 4A shows the process cartridge PC, which is one of the four PCs included in the illustrative embodiment, in a position placed on a desk or similar flat surface with the bottom wall 101A resting on the flat surface. FIG. 4B shows the process cartridge PC supported by the guide member 100, FIG. 3.

When the PC, held in the position shown in 4B, is removed from the guide member 100 and then placed on a horizontal surface, as shown in FIG. 4A, a line L1, connecting the axis of the sleeve 126K1 and that of the first screw 126K2, is shifted toward the vertical line L2 passing through the axis of the first screw 126K2. Stated another way, an angle θ between the lines L1 and L2 shown in FIG. 4B is reduced to an angle θ' shown in FIG. 4A. Consequently, the developer is caused to gather in the space accommodating the first and second screws 126K2 and 126K3 at a position remote from the axis of the sleeve 126K1.

In the above configuration, when the process cartridge PC, i.e., the bottom wall 101A of the casing 101 is placed on a horizontal surface, the entire space inside the process cartridge PC is inclined with the result that the developer with fluidity, if present in the developing device, is forcibly moved due to gravity. Particularly, the space inside the process cartridge PC is inclined such that the developer gathers at a position remote from the axis of the sleeve 126K1, preventing the developer from moving toward the space accommodating the sleeve 126K1. This successfully prevents the developer from leaking to the outside via the exposed portion of the sleeve 126K1.

In the illustrative embodiment, a seal member 126K5 is positioned at the boundary between the space accommodating the sleeve 126K1 and the space accommodating the screws 126K2 and 126K3. More specifically, as shown in FIGS. 4A and 4B, the seal member 126K5 sealingly separates the above two spaces until the developing unit has been mounted to the process cartridge PC. In this condition, a developer stored in the space, which accommodates the first and second screws 126K2 and 126K3, beforehand is prevented from accidentally moved toward the space accommodating the sleeve 126K1 due to, e.g., vibration.

FIG. 4A and FIG. 4B show the developing device with the seal member 126K5 mounted thereon. The seal member 126K5 is pulled out from the developing device when the developing device is mounted to the process cartridge PC, so that the spaces accommodating the sleeve 126K1 and screws 126K2 and 126K3, respectively, are communicated to each other to allow the developer to be fed from the former to the latter.

As stated above, in the illustrative embodiment, when the process cartridge PC is removed from the image forming apparatus or held in a packed condition, the bottom wall 101A of the casing 101 is placed on a desk or similar horizontal surface. In this condition, the spaces accommodating the sleeve 126K1 and screws 126K2 and 126K3, respectively, are inclined in a position that allows the developer present in the space assigned to the screws 126K2 and 126K3 to gather at a position remote from the axis of the 126K1, so that the developer is prevented from moving toward the space assigned to the sleeve 126K1.

Particularly, in a packed condition, the sleeve member 126K5 sealingly separates the two spaces from each other to thereby prevent the developer from moving toward the space assigned to the sleeve 126K1 due to vibration during transport or installation. Even through the seal member 101A maybe peeled off before expected timing by accident, the movement of the developer toward the space accommodating the sleeve 126K1 is obviated simply because the bottom wall 101A of the casing 101 is placed on a horizontal plane.

The illustrative embodiment with the configuration described above surely obviates the leakage of the developer only if the bottom wall 101A of the casing 101 is placed on a horizontal surface, thereby making it needless for the user of the image forming apparatus to prepare a special base or structural part or rely on a serviceman call; otherwise, the image forming operation would be interrupted.

If desired, the inclined flat surface of the bottom 101A of the casing 101 may be replaced with a surface formed with a cut or a surface provided with legs at four corners thereof in order to facilitate the formation of an opening PC2 or easy conveyance of the process cartridge PC. The crux is that the bottom wall 101A be capable of preventing the casing 101 from falling down or preventing the developer from flowing when put on a horizontal surface.

Figure 5:
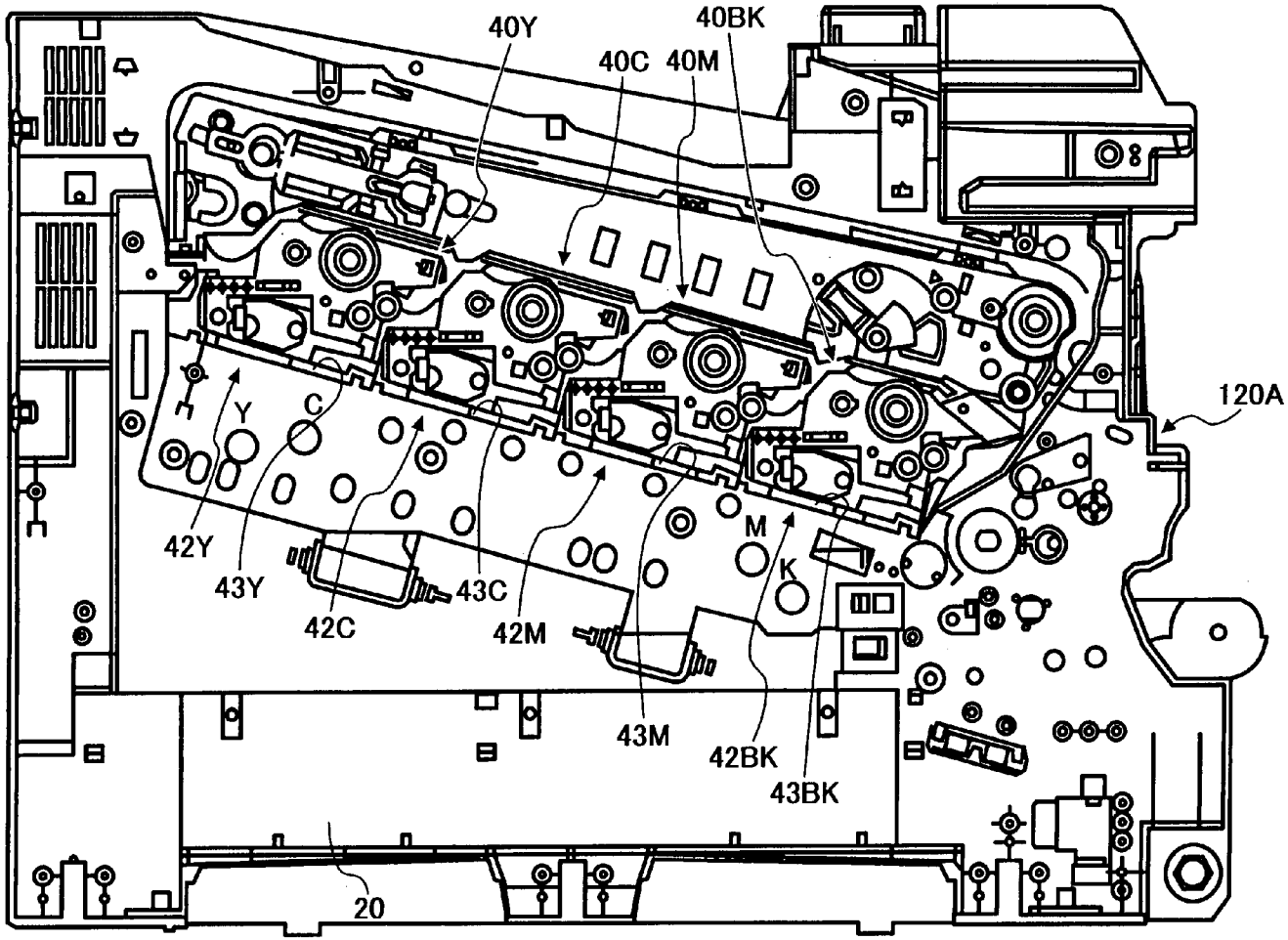
FIG. 5 is an external side elevation showing the image forming apparatus including a mechanism for mounting and dismounting the process cartridge.

Reference will be made to FIG. 5 for describing a mechanism for mounting and dismounting the process cartridge PCs. In the illustrative embodiment, the entire image transferring device 122 is inclined such that part of the lower run of the belt 122A passed over one roller is positioned at a lower level than the other part passed over the other roller, as stated with reference to FIG. 2 previously. FIG. 5 shows the image transferring device 122 in an external side elevation.

As shown in FIG. 5, a plurality of process cartridges, labeled 40Y, 40C, 40M and 40BK for convenience, each include an image carrier and at least one image forming device or unit for forming a toner image on the image carrier. The process cartridges 40Y through 40BK are arranged side by side along the inclined lower run of the belt 122A and removable from the apparatus body.

The apparatus body includes guides 42Y, 42C, 42M and 42BK including support surfaces 43Y, 43C, 42M and 42BK, respectively, that support the bottoms of the process cartridges 40Y through 40BK during mounting or dismounting of the process cartridges 40Y through 40BK. The support surfaces 43Y through 43BK each are located at a particular level or height.

In FIG. 5, the belt 1, not shown, is accommodated in the casing of the image transferring device 122 although not shown specifically. As shown in FIG. 2, the belt 1 is inclined such that its lower run is inclined by an angle of about 15° relative to a horizontal plane. Toner images formed on the image carriers of the consecutive process cartridges 40Y through 40BK are sequentially transferred to the belt 1 one above the other, completing a full-color image. Subsequently, the full-color image is transferred from the belt 1 to a paper sheet or similar recording medium.

Figure 6:
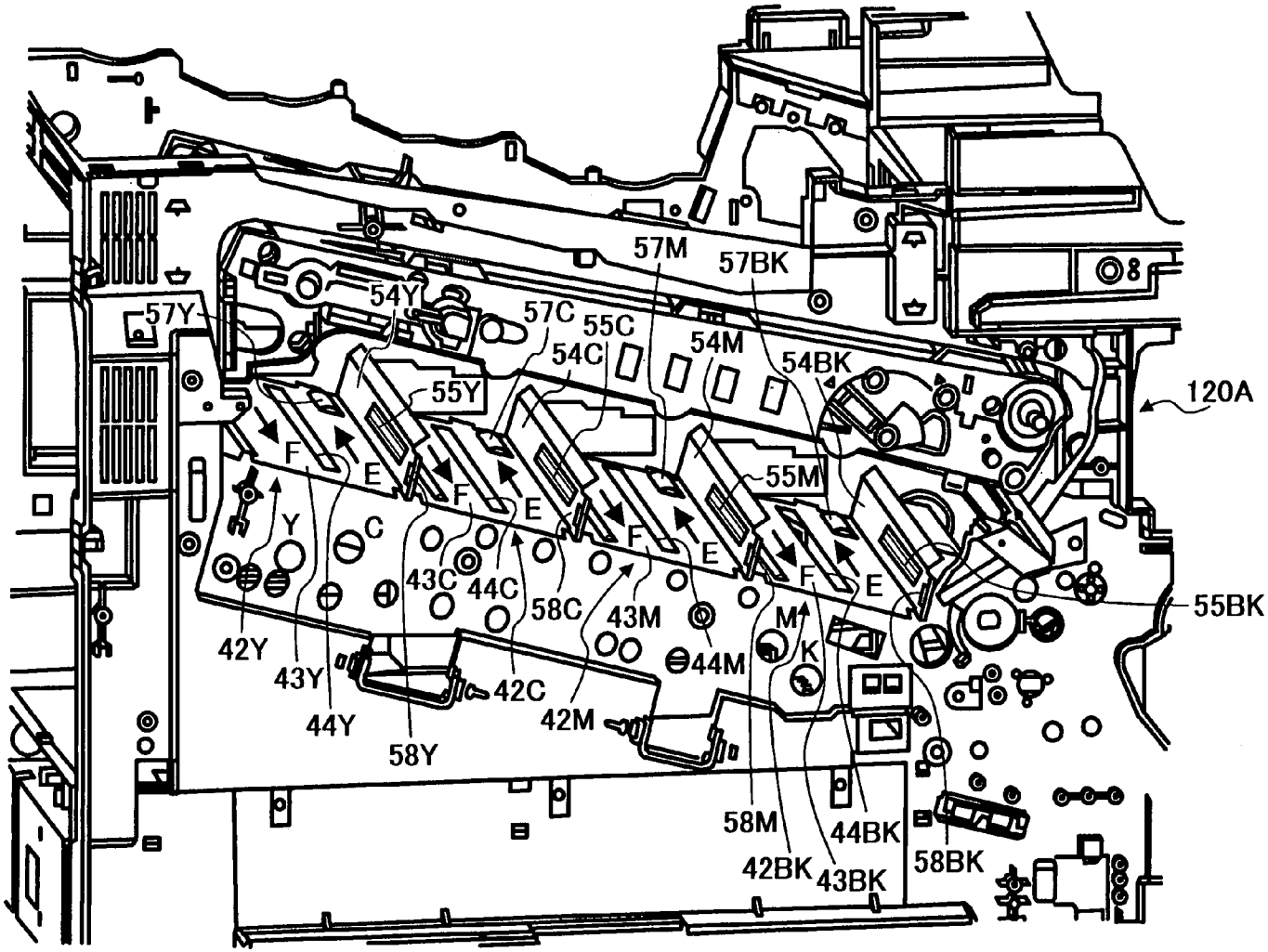
FIG. 6 shows the process cartridge dismounted from the image forming apparatus.

FIG. 6 shows the inside of the image transferring device of FIG. 5 in a condition wherein end plates, not shown, for openably covering opposite ends of the image transferring device are opened. As shown, the support surfaces 43Y through 43BK, corresponding to support walls that support the process cartridges, each are implemented as an inclined flat surface.

As shown in FIG. 6, the support surfaces 43Y through 43BK of the guide members 42Y through 42BK, respectively, are positioned substantially parallel to the lower run of the belt 122A, FIG. 2. As shown in FIG. 6, the process cartridges 40Y through 40BK each are mounted to the apparatus body in a direction E or dismounted from the same in a direction F while being supported by one of the support surfaces 43Y through 43BK assigned thereto. The support surfaces 43Y through 43BK are formed with windows 44Y trough 44BK, respectively, for passing laser beams emitted from the optical writing unit 129, FIG. 2.

Figure 7:
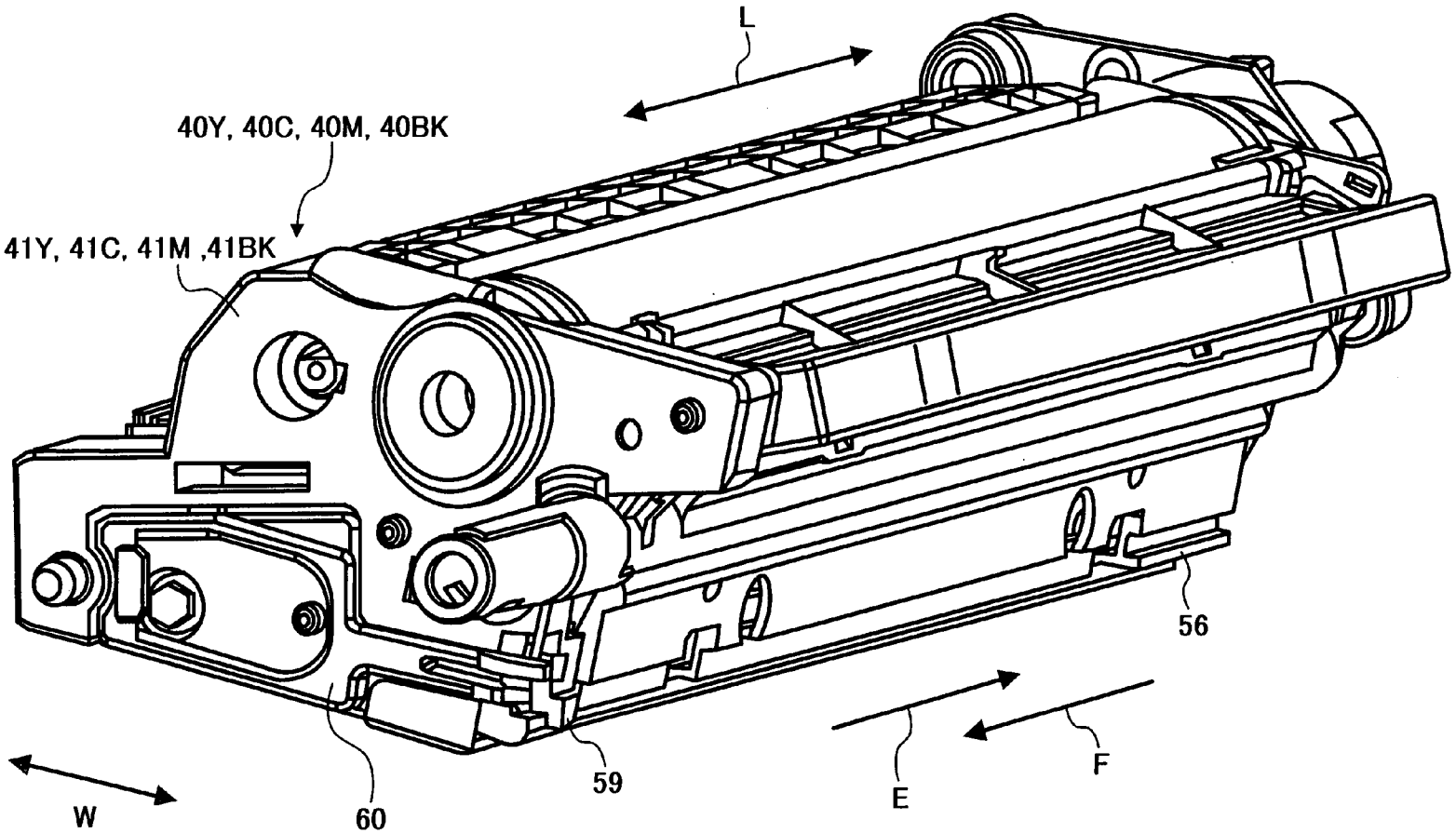
FIG. 7 is an external isometric view of the process cartridge.
Figure 8:
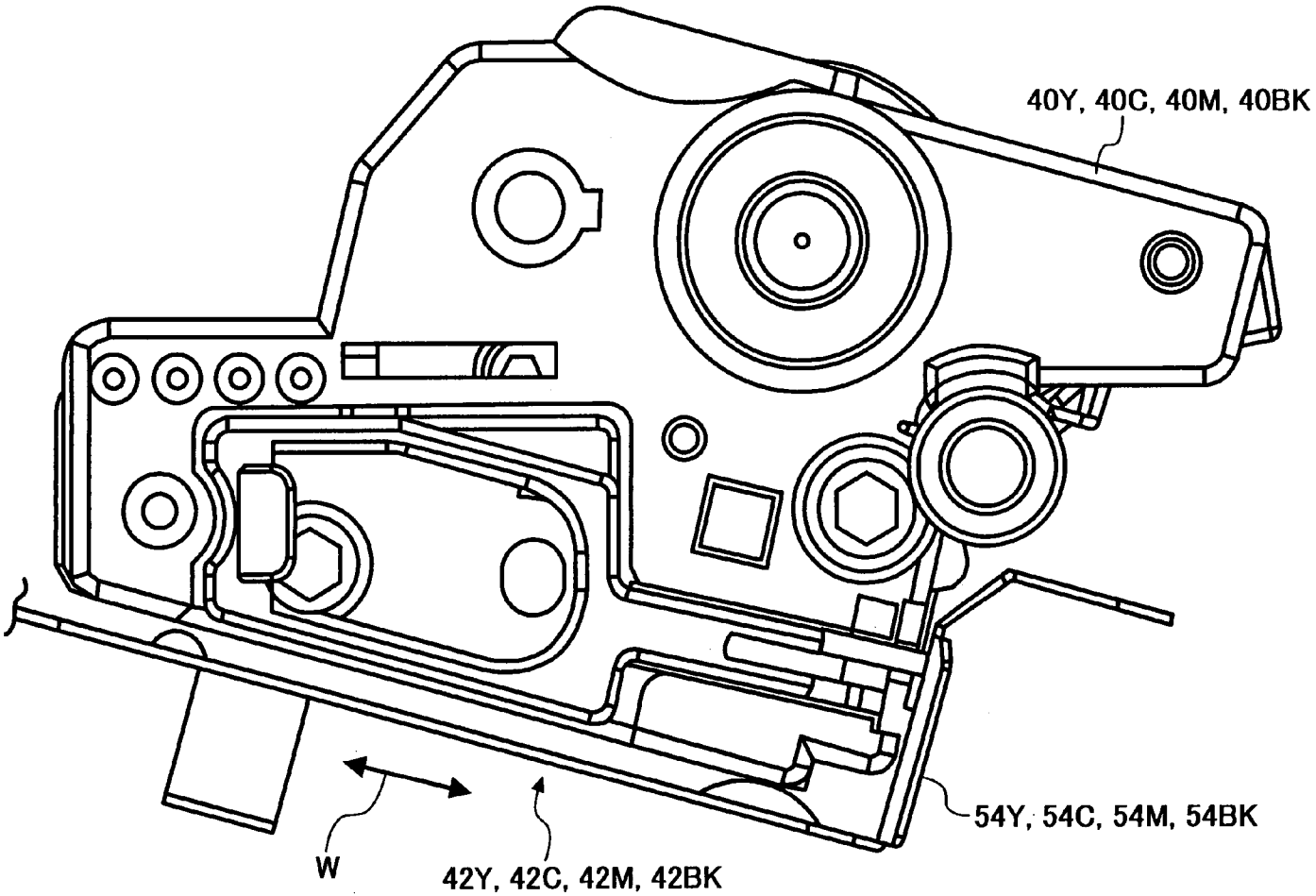
FIG. 8 is a front view of the process cartridge mounted to the image forming apparatus.
Figure 9:
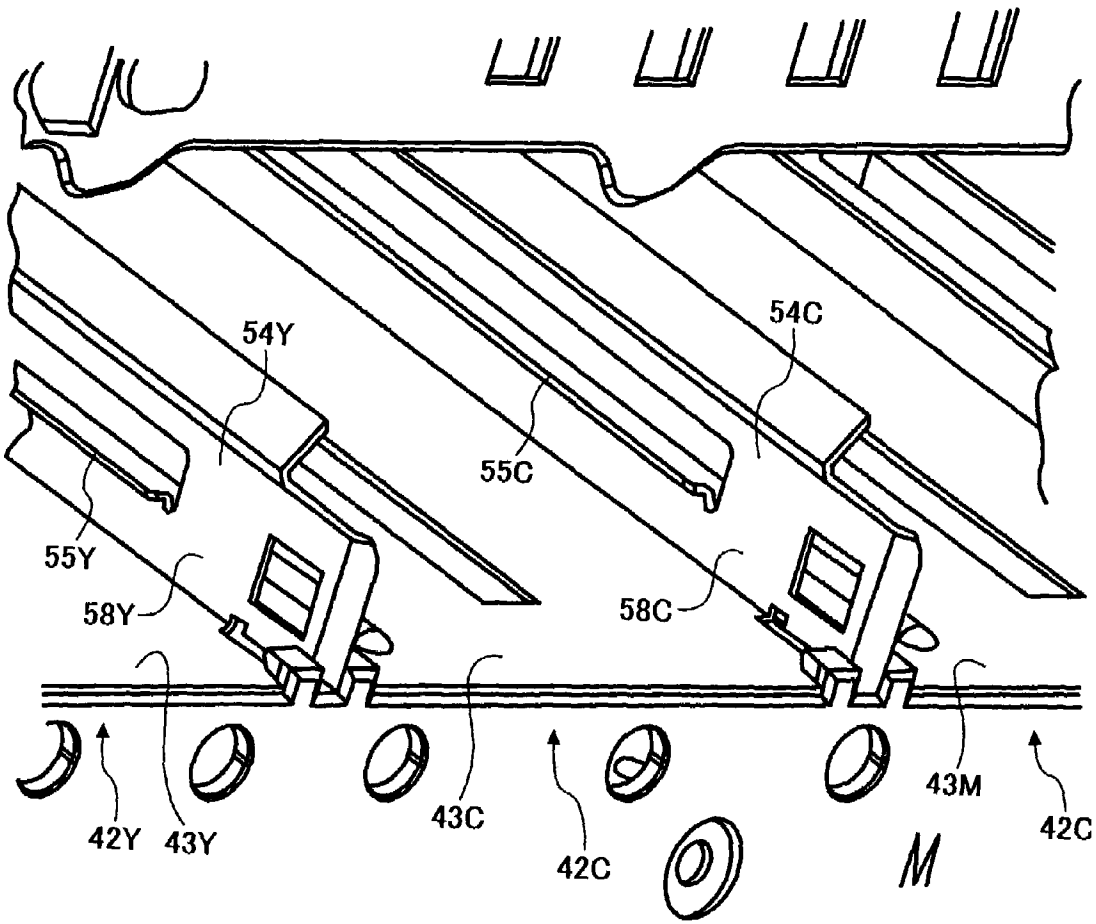
FIG. 9 is a fragmentary enlarged view showing part of the inside of an image transferring device also included in the illustrative embodiment.
Figure 10:
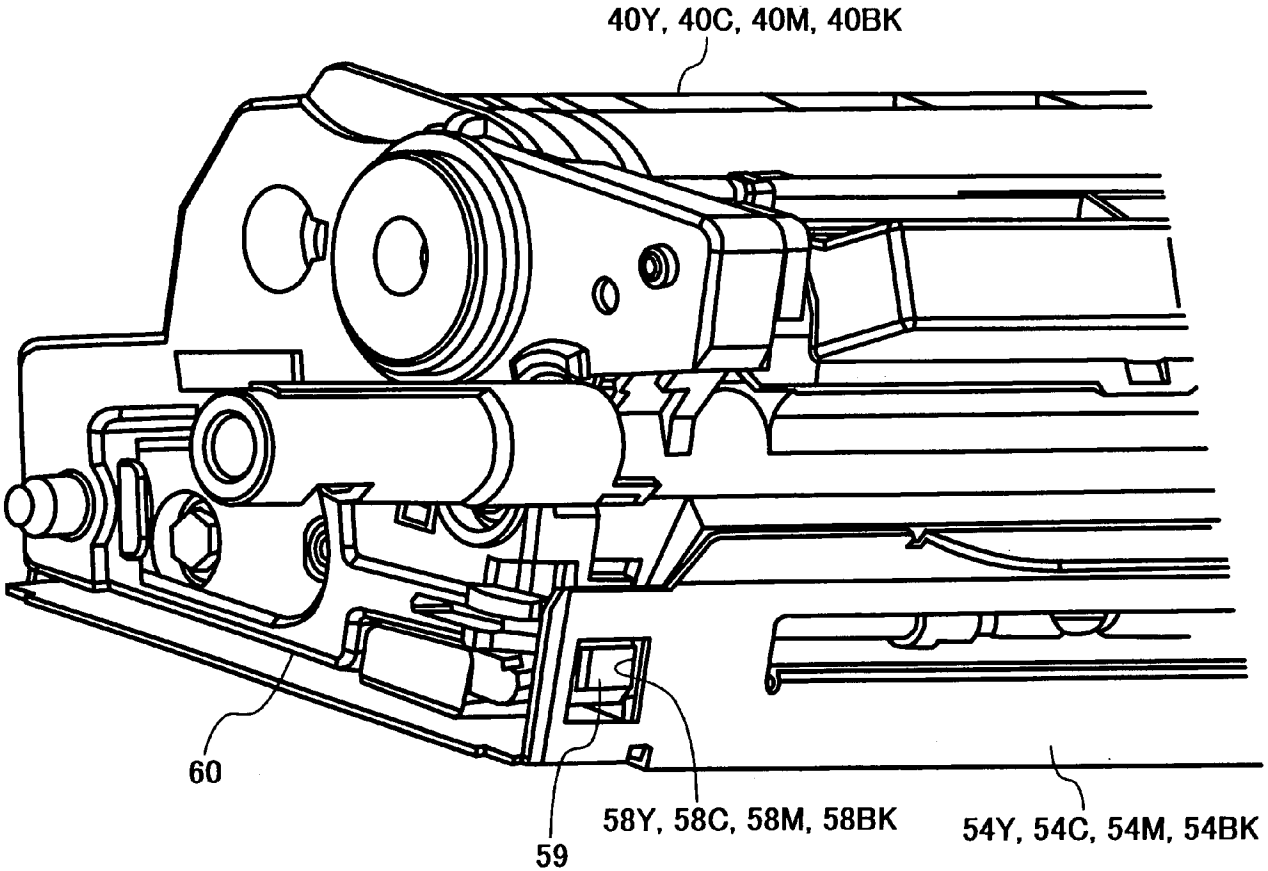
FIG. 10 is a fragmentary enlarged view showing the process cartridge held in the position of FIG. 7.
Figure 11:
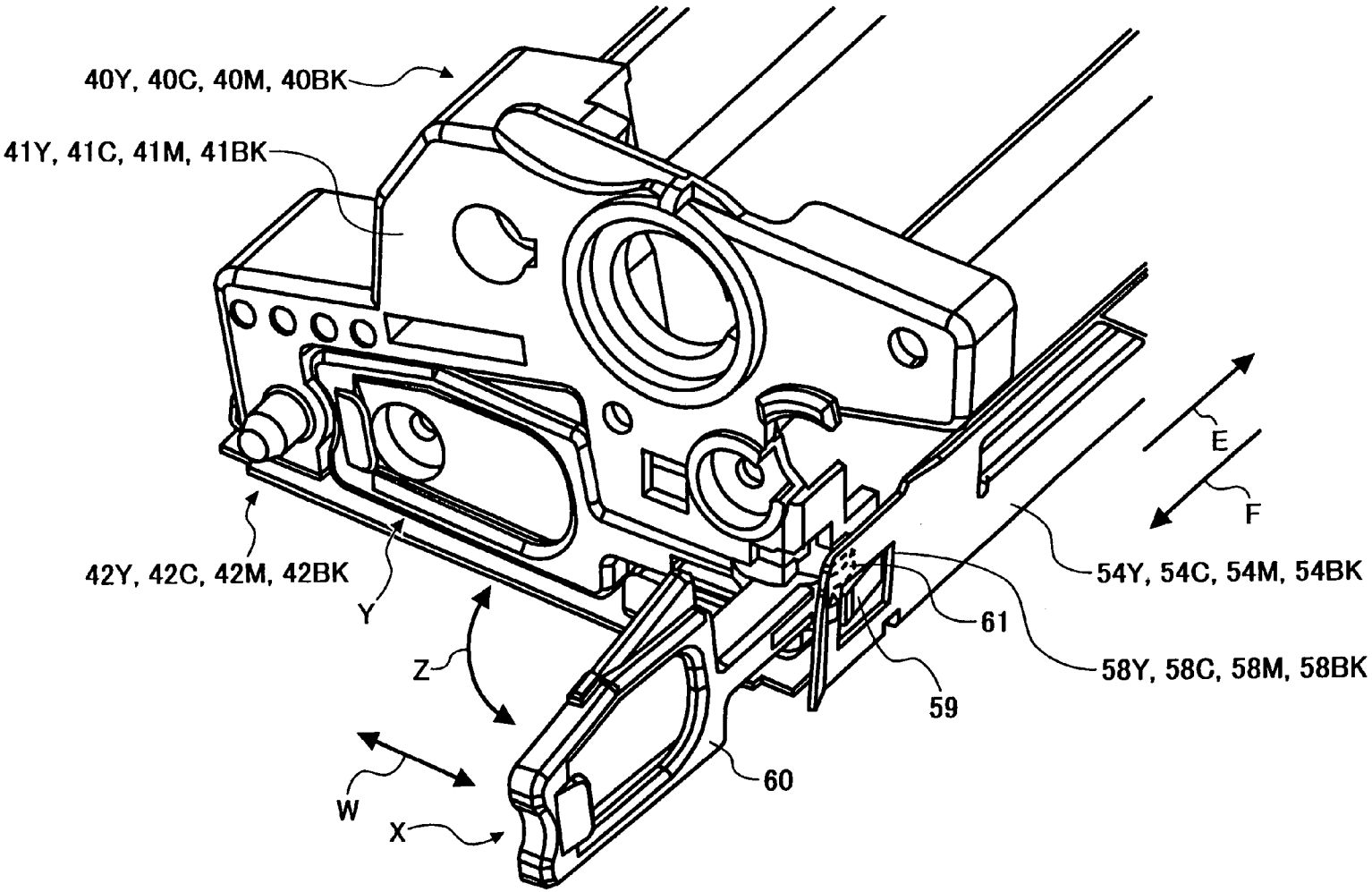
FIG. 11 is a perspective view showing how a handle mounted on the process cartridge is turned by hand.

FIG. 7 is an external view showing one of the process cartridges 40Y through 40BK while FIG. 8 is a front view showing the process cartridge mounted to the apparatus body while being guided by associated one of the guides 42Y through 42BK. FIG. 9 is a fragmentary view showing part of the inside of the apparatus body, FIG. 5, from which the process cartridges are removed. FIGS. 10 and 11 are fragmentary isometric views showing front part of one of the process cartridges 40Y through 40BK mounted to the apparatus body. The mounting direction and dismounting direction of each process cartridge are again indicated by arrows E and F, respectively.

As shown in FIGS. 5 and 6, the illustrative embodiment further includes restricting means for preventing each process cartridge from moving in the direction perpendicular to the mounting and dismounting directions E and F when mounted to or dismounted from the apparatus body 120A. More specifically, as shown in FIG. 8, the restricting means are implemented as restricting portions 54Y, 54C, 54M and 54BK, which are constituted by plates extending substantially perpendicularly upward from the support surfaces 43Y through 43BK, respectively. These restricting portions 54Y through 54BK constitute the generally L-shaped guides 42Y through 42BK, respectively, in combination with the support surfaces 43Y through 43BK.

In the above configuration, when any one of the process cartridges 40Y through 40BK is mounted to or dismounted from the apparatus body 120A in the direction E or F, respectively, one of the support surfaces 43Y through 43BK assigned thereto guides the substantially flat bottom of the process cartridge. At this instant, the process cartridge 40 contacts one of the restricting portions 54Y through 54BK adjoining it due to its own weight. The restricting portions 54Y through 54BK respectively support the sides of the process cartridges 40Y through 40BK being mounted to or dismounted from the apparatus body 120A, thereby preventing the process cartridges from being displaced in the width wise direction w, see FIG. 7, of each process cartridge.

The process cartridges 40Y through 40BK can therefore be smoothly mounted to or dismounted from the apparatus body 120A without being shifted in the widthwise direction W. It is to be noted that as shown in FIG. 7, the widthwise direction W of each process cartridge is perpendicular to the lengthwise direction, labeled L, of the same.

If the image carrier of any one of the process cartridges 40Y through 40BK being mounted to or dismounted from the apparatus body 120A contacts or slides on the belt 122A, then it is likely that the surface of the image carrier and/or the surface of the belt 122A is damaged. To solve this problem, as shown in FIGS. 6 and 9, the illustrative embodiment additionally includes up-and-down guide portions 55Y, 55C, 55M and 55BK configured to restrict the upward movement of the process cartridges 40Y through 40BK, respectively, during mounting or dismounting. In the illustrative embodiment, sheet metals or similar plates are partly cut and bent to form the up-and-down guide portions 55Y through 55BK. The up-and-down guide portions 55Y through 55BK are spaced above the support surfaces 43Y through 43BK, respectively.

On the other hand, as shown in FIG. 7, unit cases 41Y through 41BK included in the process cartridges 40Y to 40BK, respectively, each are formed with a projection or engaging portion 56 at one end portion thereof, which is the rear end portion when the process cartridge is mounted to the apparatus body 120A.

In the above configuration, when any one of the process cartridges 40Y through 40BK is mounted to the apparatus body 120A while being guided by associated one of the guides 42Y through 42BK, the projection 56 mates with associated one of the guide portions 55Y through 55BK. This is also true when the process cartridge is dismounted from the apparatus body 120A. It is therefore possible to prevent the process cartridge from moving upward and causing its image carrier to contact and scratch the belt 122A.

Further, as shown in FIG. 6, the length of each of the up-and-down guide portions 55Y through 55BK is smaller than the length of each of the support surfaces 43Y through 43BK. Therefore, when any one of the process cartridges 40Y through 40BK is inserted into the apparatus body 120A halfway, the projection 56 of the process cartridge slips out of associated one of the up-and-down guide members 55Y through 55BK. It follows that the process cartridge can move upward when brought to a preselected position in the apparatus body 120A, allowing the image carrier of the process cartridge to accurately contact the belt 122A. Stated another way, the up-and-down guide portions 55Y through 55BK restrict the upward movement of the process cartridges 40Y through 40BK, respectively, when the process cartridges are inserted to the preselected position mentioned above.

As shown in FIG. 6, in the illustrative embodiment, bulges 57Y, 57C, 57M and 57BK respectively protrude upward from the deep portions of the support surfaces 43Y through 43BK. When any one of the process cartridges 40Y through 40BK is inserted deeper into the apparatus body 120A, the process cartridge 40 gets on associated one of the bulges 55Y through 55BK after the projection 56 slips out of the associated one of the up-and-down guide portions 55Y through 55BK. As a result, the process cartridge 40 is raised to the position where the image carrier thereof contacts the belt 122A.

When the process cartridges 40Y through 40BK are mounted to the apparatus body 120A, they must be accurately locked at preselected positions. For this purpose, as shown in FIGS. 6 and 9 through 11, the sheet metals or similar plates, constituting the restricting portions 54Y through 54BK, are respectively formed with positioning holes 58Y, 58C, 58M and 58BK in front end portions thereof. On the other hand, as shown in FIGS. 7, 10 and 11, the unit cases 41Y through 41BK of the process cartridges 40Y through 40BK, respectively, are formed with reference lugs or reference portions 59 at front end portions thereof.

In the above configuration, as shown in FIGS. 10 and 11, when any one of the process cartridges 40Y through 40BK is inserted into the apparatus body 120A to the deepest position, the reference lug 59 of the process cartridge drops in associated one of the positioning holes 58Y through 58BK of the restricting portions 54Y through 54BK due to the own weight of the process cartridge, positioning the process cartridge on the apparatus body 120A in the lengthwise direction L. In the illustrative embodiment, compression springs or similar biasing means, not shown, bias the process cartridges 40Y through 40BK from the deepest end of the apparatus body 120A, so that the process cartridges 40Y through 40BK, positioned in the lengthwise direction L, are locked in such positions. It is to be noted that the positioning holes 58Y through 58BK are a specific form of positioning means for positioning the process cartridges 40Y through 40BK.

As stated above, the illustrative embodiment includes a positioning portion configured to position, when any one of the process cartridges 40Y through 40BK is mounted to the apparatus body 120A, the process cartridge is positioned in the lengthwise direction L. Stated another way, the process cartridges 40Y through 40BK each include a reference portion configured to mate with a positioning portion included in the apparatus body 120A when the process cartridge is mounted to the apparatus body 120A. The reference portion and positioning portion cooperate to lock the process cartridge in the lengthwise direction L.

While the illustrative embodiment fully positions each process cartridge by using a reference portion and a positioning portion stated above, an arrangement may alternatively be made such that after the process cartridge has been temporarily positioned by the reference portion and positioning portion, an openable face plate, mounted on the process cartridge for covering the side of the image transferring device, is closed to thereby fully position the process cartridge.

To remove any one of the process cartridges 40Y through 40BK from the apparatus body 120A, the operator of the apparatus should only remove the reference lug 59 of the process cartridge from associated one of the positioning holes 58Y through 58BK for thereby unlocking it in the lengthwise direction L and then pull the process cartridge toward the operator. At this instant, it is preferable to use the following configuration for unlocking the process cartridge.

As shown in FIGS. 7, 8, 10 and 11, a handle 60 is mounted on the front portion of the unit case of each process cartridge and angularly movable between an operative or usable position X and an inoperative or stored position Y in a direction indicated by an arrow Z. FIGS. 7, 8 and 10 show the handle 60 held in the inoperative position.

The handle 60 is held in the inoperative operation Y when the associated process cartridge is set on the apparatus body 120A. The handle 60 is angularly moved to the operative position X, FIG. 11 when the process cartridge should be removed from the apparatus body 120A. Consequently, a cam portion 61, formed at the base end of the handle 60, abuts against and presses associated one of the restricting portions 54Y through 54BK. The process cartridge is therefore slightly moved away from the restricting portion by the reaction of the restricting portion, so that the reference lug 59 is released from associated one of the positioning holes 58Y through 58BK. In this condition, the process cartridge can be easily pulled out of the apparatus body 120 only if the handle 60 is pulled out by hand.

In summary, it will be seen that the present invention provides a process cartridge having the following various unprecedented advantages and an image forming apparatus using the same.

A developer is surely prevented from leaking to the outside via gaps between the circumference of a sleeve and the inside wall of a casing. Particularly, the developer, present in a space accommodating a conveyor or agitator, gathers at a position remote from the axis of the sleeve due to gravity and is therefore prevented from moving from the above space to a space accommodating the sleeve and leaking via the space assigned to the sleeve.

Further, when the process cartridge is placed on a desk or similar flat surface in a condition packed independently of the apparatus body, the process cartridge itself can prevent the developer from leaking to the outside. This makes it needless for the user of the apparatus to prepare a special base or structural part and frees the apparatus from downtime ascribable to, e.g., a serviceman call.

Various modifications will become possible for those skilled in the art after receiving the teachings of the present disclosure without departing from the scope thereof.

What is claimed is:

1. A process cartridge, comprising:

a casing configured to accommodate a plurality of units positioned one above the other in a space within said casing such that one of said plurality of units is spaced, in a horizontal direction, from a vertical line extending through the other unit positioned below said one unit, said plurality of units including an image carrier, a sleeve configured to cause a developer to electrostatically deposit on said image carrier, and a conveying member positioned below said sleeve and disposed in a first space separate from a second space accommodating said sleeve, said conveying member configured to feed said developer to said sleeve while agitating said developer, wherein said casing includes a continuous flat bottom wall that extends beneath each of the plurality of units and that is inclined relative to a horizontal plane and oriented such that when said bottom wall is placed on a horizontal surface, said one unit is shifted toward said vertical line, and wherein said plurality of units are arranged in said casing and said continuous flat bottom wall is inclined relative to the horizontal plane such that said casing is configured to be mounted in an image forming apparatus with said continuous flat bottom wall extending substantially parallel to a portion of a lower run of an image transfer belt of the image forming apparatus that extends between two photoconductive drums that are respectively included in two process cartridges that are consecutively arranged in the image forming apparatus.

2. The process cartridge as claimed in claim 1, wherein the bottom wall of said casing is inclined by an angle that causes, when the bottom wall of said casing is placed on the horizontal surface, a line connecting an axis of said sleeve and an axis of said conveying member to be shifted toward the vertical line, whereby the developer in said second space assigned to said sleeve is caused to gather at a position remote from said axis of said sleeve.

3. The process cartridge as claimed in claim 1, wherein said conveying member comprises a first screw and a second screw positioned side by side in a horizontal direction independently of the bottom wall of said casing.

4. The process cartridge as claimed in claim 3, wherein the continuous flat bottom wall is inclined with respect to a plane that passes through a rotational axis of each of the first and second screws.

5. The process cartridge as claimed in claim 1, wherein a removable seal member is positioned between said space assigned to said sleeve and said space assigned to said conveying member.

6. The process cartridge as claimed in claim 5, wherein said conveying member comprises a first screw and a second screw positioned side by side in a horizontal direction independently of the bottom wall of said casing.

7. An image forming apparatus configured to use a process cartridge, said image forming apparatus comprising:

an image transfer belt;

a process cartridge guide that includes a process cartridge support surface that extends substantially parallel to a portion of a lower run of said image transfer belt that extends between two photoconductive drums that are respectively included in two process cartridges that are consecutively arranged in the image forming apparatus; and a process cartridge including:

a casing configured to accommodate a plurality of units positioned one above the other in a space within said casing such that one of said plurality of units is spaced, in a horizontal direction, from a vertical line extending through the other unit positioned below said one unit, said plurality of units including an image carrier, a sleeve configured to cause a developer to electrostatically deposit on said image carrier, and a conveying member positioned below said sleeve and disposed in a first space separate from a second space accommodating said sleeve, said conveying member configured to feed said developer to said sleeve while agitating said developer, wherein said casing includes a continuous flat bottom wall that extends substantially parallel to said process cartridge support surface, that extends beneath each of the plurality of units and that is inclined relative to a horizontal plane and oriented such that when said bottom wall is placed on a horizontal surface, said one unit is shifted toward said vertical line.

8. The apparatus as claimed in claim 7, wherein said process cartridge is removably mounted to a body of said apparatus.

9. The apparatus as claimed in claim 8, wherein a two-ingredient type developer made up of toner and carrier is stored in said space assigned to said conveying member beforehand.

10. The process cartridge as claimed in claim 1, wherein the continuous flat bottom wall extends beneath the conveying member from a first vertical side wall of the casing to second vertical side wall of the casing, and wherein the conveying member is disposed in the casing, in the horizontal direction, between the first vertical wall and the image carrier.

11. The process cartridge as claimed in claim 10, wherein the first vertical sidewall of the casing is located on a side of the conveying member that is furthest from the image carrier in the horizontal direction and the second vertical sidewall of the casing is located below the image carrier.

12. The apparatus as claimed in claim 7, wherein the continuous flat bottom wall extends beneath the conveying member from a first vertical side wall of the casing to second vertical side wall of the casing, and wherein the conveying member is disposed in the casing, in the horizontal direction, between the first vertical wall and the image carrier.

13. The process cartridge as claimed in claim 12, wherein the first vertical sidewall of the casing is located on a side of the conveying member that is furthest from the image carrier in the horizontal direction and the second vertical sidewall of the casing is located below the image carrier.

14. The process cartridge as claimed in claim 7, wherein said conveying member comprises a first screw and a second screw positioned side by side in the horizontal direction, and wherein the continuous flat bottom wall is inclined with respect to a plane that passes through a rotational axis of each of the first and second screws.

15. The apparatus as claimed in claim 7, wherein said process cartridge guide includes a process cartridge restricting portion that extends substantially perpendicular to said process cartridge support surface, and wherein said process cartridge guide includes an up-and-down guide member that projects from said process cartridge restricting portion over said process cartridge support surface and that engages said casing of said process cartridge.

16. The apparatus as claimed in claim 15, wherein a bulge protrudes upwards from said process cartridge support surface so as to raise said process cartridge to a position where said image carrier of said process cartridge contacts said image transfer belt.

17. A process cartridge, comprising:

a plurality of units including an image carrier, a sleeve configured to cause a developer to electrostatically deposit on said image carrier, and a conveying member positioned below said sleeve, said conveying member configured to feed said developer to said sleeve while agitating said developer, said conveying member including a first screw and a second screw positioned side by side; and a casing configured to house the plurality of units, said casing including a continuous flat bottom wall that extends beneath each of the plurality of units and that is inclined with respect to a plane that passes through a rotational axis of each of the first and second screws, said casing being configured to be mounted in an image forming apparatus such that said continuous flat bottom wall extends substantially parallel to a portion of a lower run of an image transfer belt of the image forming apparatus that extends between two photoconductive drums that are respectively included in two process cartridges that are consecutively arranged in the image forming apparatus.

18. The process cartridge as claimed in claim 17, wherein said plurality of units are positioned in said casing one above another, wherein one of said plurality of units is spaced, in a horizontal direction, from a vertical line extending through another one of the plurality of units positioned below said one unit, and wherein said continuous flat bottom wall is inclined relative to a horizontal plane and oriented such that when said bottom wall is placed on a horizontal surface, said one unit is shifted toward said vertical line.

19. The process cartridge as claimed in claim 17, wherein the continuous flat bottom wall extends beneath the conveying member from a first vertical side wall of the casing to second vertical side wall of the casing, and wherein the conveying member is disposed in the casing, in a horizontal direction, between the first vertical wall and the image carrier.

20. The process cartridge as claimed in claim 19, wherein the first vertical sidewall of the casing is located on a side of the conveying member that is furthest from the image carrier in the horizontal direction and the second vertical sidewall of the casing is located below the image carrier.

* * * * *